US005264838A

United States Patent [19]

Johnson et al.

[11] Patent Number: 5,264,838

[45] Date of Patent: Nov. 23, 1993

[54] APPARATUS FOR GENERATING AN ANTI-ALIASED DISPLAY IMAGE HALO

[75] Inventors: Michael J. Johnson, Phoenix, Ariz.; Brent H. Larson, Missouri City, Tex.

[73] Assignee: Honeywell Inc., Minneapolis, Minn.

[21] Appl. No.: 751,911

[22] Filed: Aug. 29, 1991

[51] Int. Cl.[5] ..... G09G 5/00

[52] U.S. Cl. ..... 345/138; 345/144; 345/98

[58] Field of Search ..... 340/723, 728, 730, 744, 340/747, 750, 733, 731; 358/182

[56] References Cited

U.S. PATENT DOCUMENTS

| | | | |
|---|---|---|---|
| 4,837,562 | 6/1989 | Nishiura et al. | 340/728 |
| 4,908,780 | 3/1990 | Priem et al. | 340/744 |
| 4,952,921 | 8/1990 | Mosier | 340/728 |
| 4,959,801 | 9/1990 | Apley et al. | 340/723 |
| 5,005,011 | 4/1991 | Perlman et al. | 340/728 |
| 5,054,100 | 10/1991 | Tai | 340/728 X |
| 5,060,172 | 10/1991 | Engelse et al. | 340/728 |
| 5,063,375 | 11/1991 | Lien et al. | 340/728 |

FOREIGN PATENT DOCUMENTS

| | | |
|---|---|---|
| 0145181A3 | 6/1985 | European Pat. Off. . |
| 0393756A1 | 10/1990 | European Pat. Off. . |
| 0427147A2 | 5/1991 | European Pat. Off. . |

*Primary Examiner*—Jeffery Brier
*Attorney, Agent, or Firm*—John G. Shudy, Jr.

[57] ABSTRACT

Apparatus and method are disclosed for providing a halo (background region) around selected image data in an anti-aliased image processing system. The anti-aliased image processing system applies a distribution function to an image (impulse) point so that the impulse point contributes to the display for a plurality of pixels. In order to provide a halo, a second or halo distribution function, extending beyond the anti-aliasing distribution function, is assigned to selected impulse points. For the current pixel, the pixel for which the display attributes are being determined, the contribution to the current pixel from neighboring pixels for both the anti-aliasing distribution function and the halo distribution function are determined separately. Then the contributions from each source are combined to determine the display characteristics of the currently activated pixel. The invention provides a technique for combining or prioritizing contributions from display regions including overlapping sets impulse points.

18 Claims, 5 Drawing Sheets

APPARATUS FOR GENERATING AN ANTI-ALIASED DISPLAY IMAGE HALO

RELATED APPLICATION

This application is related to U.S. patent application 07/432,105 entitled "BEAMFORMER FOR MATRIX DISPLAY", invented by Michael J. Johnson, Brent H. Larson, and William R. Hancock, filed Nov. 6, 1989, and assigned to the assignee of the present application.

BACKGROUND OF THE INVENTION

1. Field of the Invention

This invention relates generally to alpha/numeric and graphic displays and, more particularly, to displays in which selected information must be emphasized for the viewer relative to other displayed information.

2. Description of the Related Art

In U.S. patent application Ser. No. 07/432,105 identified above, a technique for processing stored image information to improve the resulting display has been described. The Application addresses the problem of the aliasing of an image. Referring to FIG. 1, a display 101 shows a line 102 with aliasing imposed thereon and the same line 103, processed using anti-aliasing techniques, is shown. Normally, the line 103, on close inspection, is seen to have a smooth profile as shown, but also to have a somewhat fuzzy appearance. The fuzzy appearance is due to the use of gray levels to move the centroid of luminance more precisely up, down, left, or right. The fuzzy appearance is normally not distracting to the viewer and, in all other aspects, the image is judged superior to the aliased image. The fuzziness can be attenuated substantially in direct proportion to the resolution of the display. When the high frequency components are processed without modification, the line 102 has a jagged appearance, each display point (or pixel) exhibiting a binary display characteristic. In addition to the jagged appearance of edges of images, the aliasing phenomenon can result in patterns superimposed on the image. Once again, the frequency response of the display permits the passage of high frequency components of the image in a manner inappropriate to the accurate reproduction of the image.

U.S. patent application No. 07/432,105 provides a solution to the aliasing problem which can be understood with reference to FIG. 2A, FIG. 2B, FIG. 3A, and FIG. 3B. The characteristics of a display pixel are determined on a pixel by pixel procedure based on the optical component characteristics (hereinafter referred to a impulses) of an impulse point stored in the form of electrical signals in image memory. Prior to U.S. Patent Application, when the pixel 25(x,y) was to be activated, the image impulse 20, being associated with pixel 25(x,y), was extracted from the image memory and applied to the circuits controlling the display of pixel 25(x,y) and pixel 25(x,y) was consequently activated to reflect the impulse characteristics. Thus, in FIG. 2B, the pixel 25(x,y) can be represented as having an intensity determined by the intensity of the impulse signal associated with that pixel location. As will be clear to those familiar with display technology, typically three (color) components are associated with each pixel. FIG. 2A and FIG. 2B illustrate only one component for ease of description.

U.S. patent application No. 07/432,105 addresses the aliasing problem by associating with each impulse a distribution which provides that, instead of being localized to one pixel, each impulse contributes to the display of surrounding pixels. Referring to FIG. 3A, a (generally Gaussian) distribution function 35 is shown surrounding the original impulse 20. The illustrated distribution function provides for a contribution not only to the pixel 25(x,y), but also to the neighboring pixels [for example, pixels 25(x−1, y), 25(x+1,y), 25(x,y−1), and 25(x,y+1) and sharing a corner with pixel 25(x,y), [i.e., 25(x−1, y−1), 25(x+1,y−1), 25(x−1,y+1), and 25(x+1,y+1)]. Typically the distribution function 35 is 6 to 7 pixels across at the base of the distribution function for a color display. This extent implies coverage of ±3 pixels in all directions centering on 25(x,y). Referring to FIG. 3B, the activation of pixel 25(x,y) and the surrounding pixels is illustrated. The neighboring pixels, border sharing pixels in this example, have a display contribution that is less than the contribution to the display of the pixel to which the impulse is assigned, while the pixels sharing corner has an even smaller contribution to the display characteristics in accordance with the distribution function, i.e., in the present example, a Gaussian distribution function.

As will be clear, the extension of the contribution of an impulse to pixels surrounding the pixel to which the impulse has been assigned provides a smoothing of the abrupt transition between the display pixel and an adjoining pixel with no impulse associated therewith. Not only will the abrupt border areas be smoothed, but the high frequency patterns can minimized or eliminated thereby minimizing the aliasing of the image.

Referring to FIG. 4, a block diagram for providing the anti-aliasing of U.S. patent application No. 07/432,105 is shown. The apparatus includes an image memory 41, the image memory 41 having a plurality of memory locations, one location being illustrated by the dotted line region 41A. The memory locations of the image memory store the impulses, in the form of digital data, which ultimately control the display, each image memory location associated with a display pixel or regions of display surface. The contents of image memory locations associated with the display pixel as a result of the distribution function are entered into a two dimensional 3×3 shift register where the contents therein access the coefficient memory 42. The coefficient memory stores the weighting coefficients that effect the desired impulse point distribution function. Following the example in FIG. 3A and FIG. 3B, the distribution function is chosen to cause contributions to all impulses in the 3×3 window which scans image memory in a manner common to processing of raster scan displays. But that distribution function implies that impulse functions in any cell of the 3×3 window centered about the current pixel, the pixel for which the display is being determined, will provide a contribution to the current pixel. Therefore, the coefficient memory 42, in the present example, includes 9 positions, one position for each pixel location from which an associated impulse can provide a contribution to the parameters of the display of the current pixel. For example, in FIG. 4, an impulse 40 is shown, when the current pixel location is 25(x,y), positioned in pixel 25(x−1,y−1). Each location in the pixel memory (of the 9 locations of the present example) has stored therewith coefficients which determine the contribution of an impulse function to the display parameters to be activated for the current pixel. Therefore, each location of the coefficient memory potentially provides a quantity which is contributed to the display of the current pixel:

$$I(i,j)=K(i,j)\times I_p(i,j)\text{ps}$$

where $I_p(i,j)$ is the intensity of the impulse associated with location (i,j);

K(i,j) is the constant which determines the contribution of $I_p(i,j)$ to the pixel at location (x,y), the impulse being further located within the pixel by an offset ($\Delta x,\Delta y$); and I(i,j) is the contribution of impulse $I_p(i,j)$ to the pixel display at location (x,y).

The intensity contributions are then applied to combining unit 43 wherein the contributions to the current pixel display are combined (typically summed):

$$I_f(x,y)=COM[I(i,j)]$$

where

COM is the algorithm defining how the contributions to the selected pixel are to be combined;

I(x,y) defines the intensity to be applied to pixel(x,y); and i and j are the indices over which the COM operation is processed, i.e., the selected pixel and the nearest neighboring pixels.

The quantity $I_f(x,y)$ is then applied to the driver circuits of the current pixel. The driver circuits of the display determine the display, on a pixel by pixel basis, in response to the output signals from the combining unit 43. The timing circuits, not shown, coordinate the application of impulses to the coefficient memory with the driver circuits to ensure the proper display parameters are provided to the current pixel, the current pixel generally being determined by a video raster scan.

U.S. patent application No. 07/432,105 also describes a refinement to the anti-aliasing technique. In this refinement, the graphics generator provides a location of an impulse within a pixel, this position generally referred to as micropositioning the impulse within the pixel. Thus in the image memory 41, each impulse memory location 41A includes a color information in location 41A' and the relative (with respect to the pixel) position of the impulse in location 41A". Referring again to FIG. 4, when an impulse 40 is located at position 40', the contribution to the current pixel 25(x,y) is much less than the when impulse 40 is positioned at location 40'. The use of micropositioning permits the display of the current pixel to take account of that difference. Although the use of micropositioning permits a display more representative of the distribution of impulses, the improved display requires increased complexity of the apparatus. Without micropositioning, the coefficients for each location of the coefficient memory are constant and the contribution to the current pixel is relatively easy to determine, although this implementation is not effective for anti-aliasing applications. With micropositioning, the contribution to the current pixel of an impulse will be a function of the impulse position within the pixel. Therefore, each coefficient memory location must be able to provide the correct functionality for each possible impulse location in the pixel. When a finite number of positions are possible for an impulse within a pixel, a simple memory addressed by the impulse relative location can be used at each coefficient memory location.

The image processing described above, while providing an improved image on the display screen, still must provide a technique for emphasizing certain characters or images that may have importance to a viewer. This emphasis is particularly important in environments such as the cockpit of an aircraft flight deck wherein a bewildering array of data must be provided to the crew of the flight deck, but wherein certain data must be easily identifiable, i.e., data requiring immediate response by the members of the flight deck. In the prior art, display areas have been emphasized by periodic alteration (i.e., flashing) of the intensity of the region of interest. The flashing display can be distracting and a rapid review of this type of display screen can be misinterpreted. Another technique for emphasizing particular information on a display screen is to provide a highlight zone into which the important information is to be displayed. This technique suffers from the concealment of information that would normally be displayed by the screen. This problem is particularly acute in those display applications wherein display screen space is limited, such as in a aircraft cockpit. Similarly, a priority mask, which is created to highlight the portion of the screen display to be accented, will also conceal displayed information which will be particularly significant in situations of limited display screen space. A change in color of the display material can be used to emphasize certain information. However, a difference or change in color is less likely to be detected in many instances than a change in luminance, especially with backgrounds having an arbitrary color. Emphasized information can also be provided with an enhanced luminance. While this technique can provide the requisite enhanced emphasis on the display screen, the lower priority information is displayed with only a fraction of the luminance range and can, therefore, be difficult to interpret.

Referring to FIG. 5, a preferred technique for emphasizing selected display regions is illustrated. The technique, called haloing or providing a halo region, is implemented by surrounding the region to be emphasized with a background border. Specifically in FIG. 5, the characters 458 on display screen 500 are shown without a halo 501 and the characters are shown with a halo 502. As is clear from the FIG. 5, the characters without the haloing 501 can be ambiguous depending on the contrast with background upon which they are superimposed. Regions 505 of different intensity are displayed as display screen background to emphasize the character recognition problem. The characters with the haloing are clearly evident against a variety of backgrounds.

A need has therefore been felt for apparatus and an associated technique which would permit haloing to be incorporated in the anti-aliasing image processing. The inclusion of the haloing processing with the anti-aliasing processing should minimize the irregularities in the border of the halo region and in the interface between the halo region and display region to be emphasized on the display screen.

FEATURES OF THE INVENTION

It is an object of the present invention to provide an improved display.

It is a feature of the present invention to provide a display in which selected features can be emphasized using haloing techniques.

It is another feature of the present invention to provide a display using anti-aliasing techniques in which each selected impulse point has a halo profile associated therewith. The halo profile determining contributions to a display pixel associated with the impulse points associated with neighboring pixels.

It is yet another feature of the present invention to provide a haloing of selected regions which is compatible with the anti-aliasing technique of the display.

It is still a further feature of the present invention to provide apparatus and an associated method which would permit one of a plurality of overlapping regions to be displayed in an anti-aliased image processing system.

SUMMARY OF THE INVENTION

The aforementioned and other features are attained, according to the present invention, by providing an anti-aliased profile around each impulse point, the anti-aliased profile attenuating contributions of impulses of lower priority in neighboring pixels to the display of a current pixel location. A second profile around each impulse is provided which determines a halo around each selected impulse point. Each impulse point includes a priority level associated therewith. The priority level and the impulse point profiles are used to determine which impulse contributions are attenuated with respect to higher priority impulses. In addition, an opacity profile can be generated which can prevent merger of signals of different priorities and can select one display region from a plurality of overlapping display regions for presentation on a display screen. The opacity profile is most evident when haloing is not selected.

These and other features of the invention will be understood upon reading of the following description along with the drawings.

DESCRIPTION OF THE PREFERRED EMBODIMENT

1. Detailed Description of the Figures

FIG. 1 through FIG. 5 have been described with relation to the related art.

Figure 1:
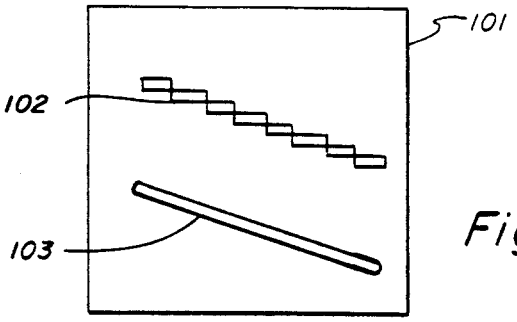
FIG. 1 illustrates the difference between an image processed according to the prior art and an image processed using anti-aliasing techniques.
Figure 2A:
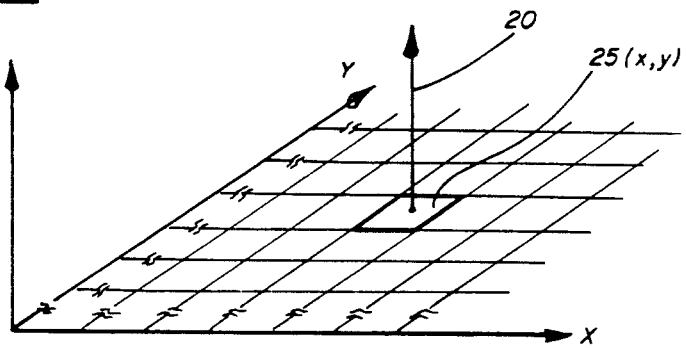
FIGS. 2A and 2B illustrate how an impulse point determines the display of a pixel without anti-aliasing techniques.
Figure 2B:
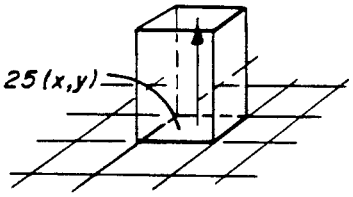
Figure 3A:
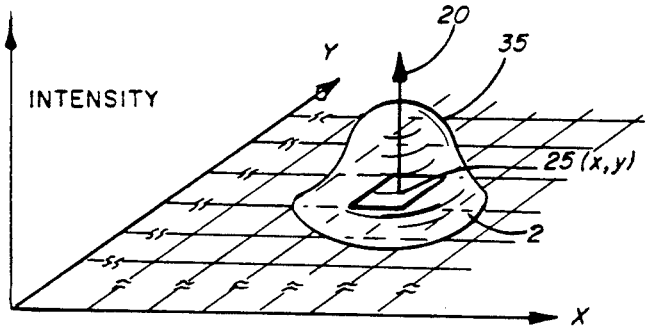
FIGS. 3A and 3B illustrate how an impulse determines the display of a pixel using anti-aliasing techniques.
Figure 3B:
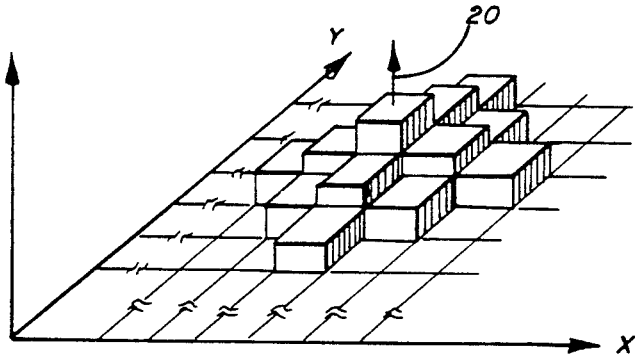
Figure 4:
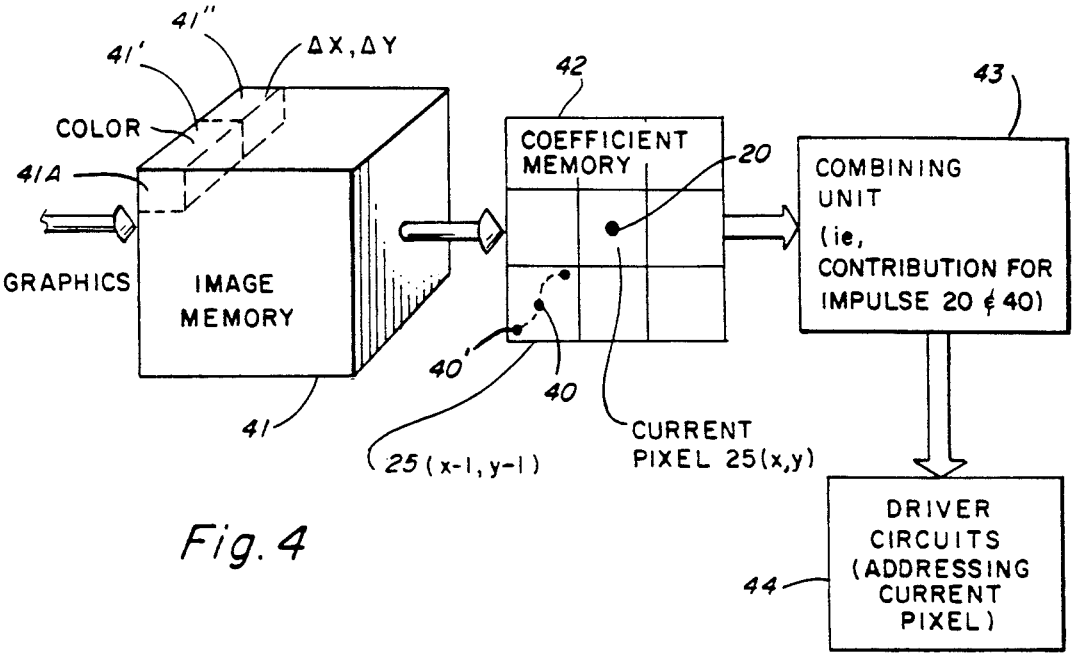
FIG. 4 is block diagram of apparatus used in determining the pixel display according to anti-aliasing techniques.
Figure 5:
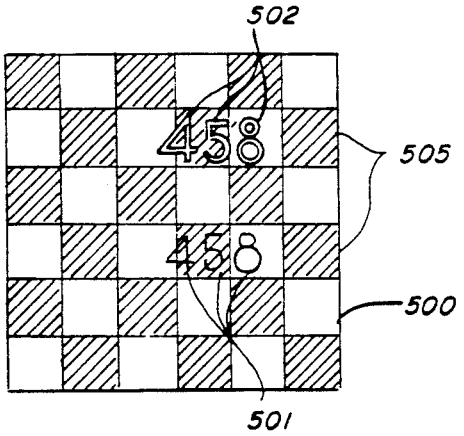
FIG. 5 illustrates the use of haloing in emphasizing a selected region.
Figure 6:
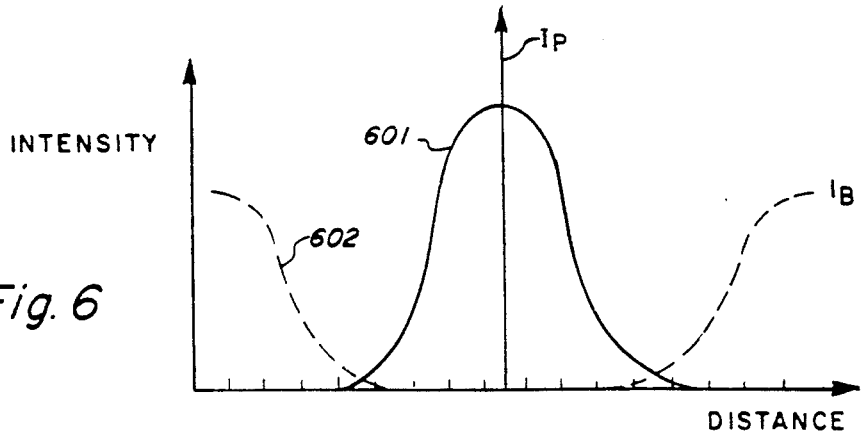
FIG. 6 illustrates both the anti-aliasing distribution function and the anti-aliasing haloing distribution function.

Referring now to FIG. 6, the distribution function for providing anti-aliasing of an impulse function and for providing the haloing of an impulse function are compared. The anti-aliasing distribution function 601 provides for a contribution from the impulse point $I_P$ to neighboring pixels, the boundaries of which are shown as tick marks. Viewed in a different manner, the display characteristics for each pixel have contributions from impulse points located in the neighboring pixels. The haloing distribution function 602 is shown as a dotted line in FIG. 6. The haloing distribution function 602 is associated with and centered around the impulse point $I_P$, but extends beyond the anti-aliasing distribution function and achieves a maximum value of $I_B$, the background or lower priority impulse point set (0% attenuation at the edges) and a minimum value (100% attenuation) at the location of the impulse. $I_B$ can be higher or lower than the peak of 601. The attenuation factor is applied against lower priority impulses or the video. This extension beyond the anti-aliasing distribution function ensures that the region resulting from selected impulse points is surrounded by an attenuated background region resulting in a high contrast dark border around the selected impulse points, the resulting border also being anti-aliased.

Figure 7:
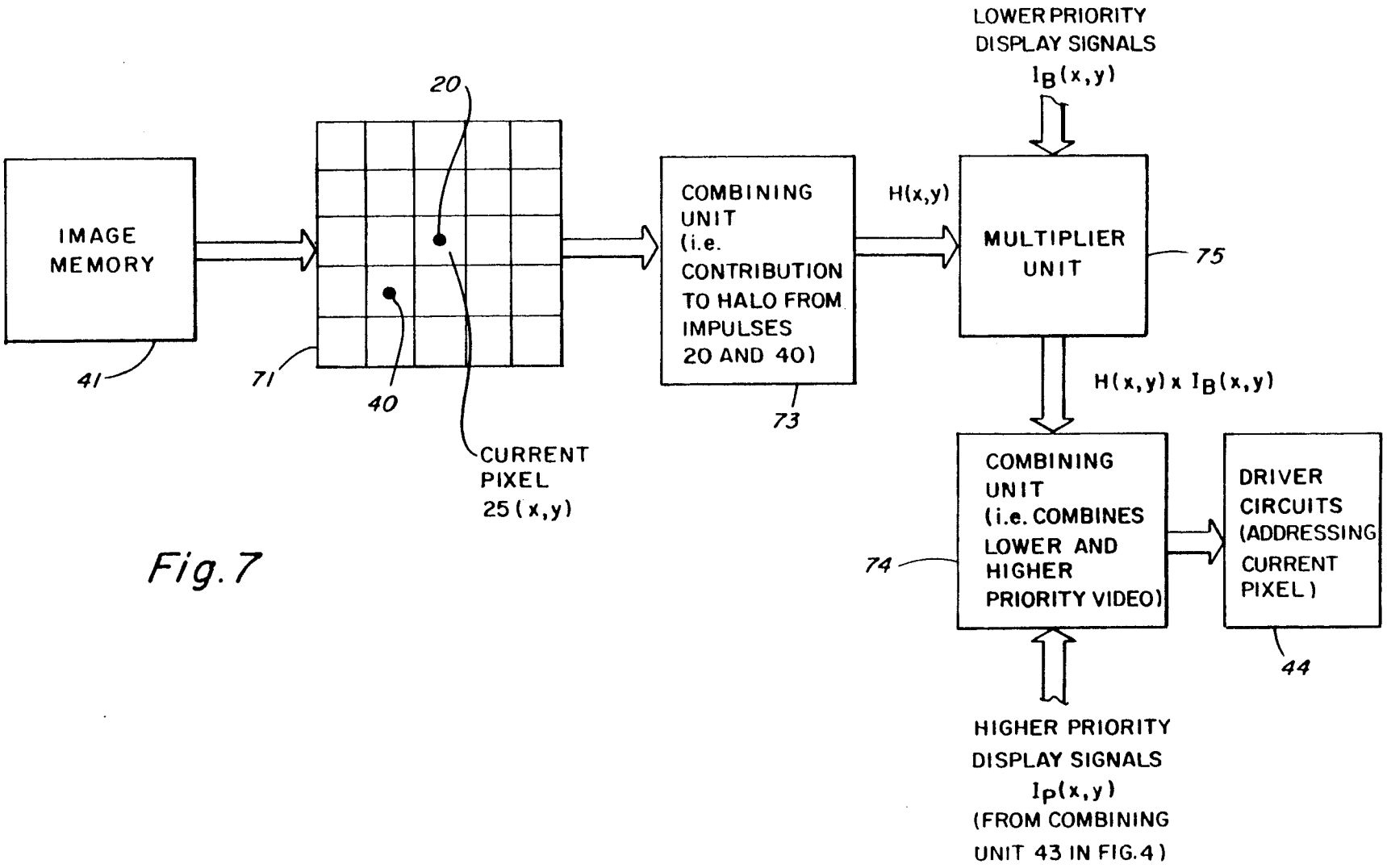
FIG. 7 is a block diagram of the apparatus for providing the halo contribution to a current pixel.

Referring next to FIG. 7, a block diagram of apparatus for generating halo regions that can be used in displays with anti-aliasing procedures is shown. A halo coefficient memory 71 is provided. The halo coefficient memory is indexed by data stored in a $5\times5$ shift register (in the present implementation). The $5\times5$ shift register is not shown separately from the coefficient memory, the two being integrated in the preferred embodiment. The data are impulse point data from the image memory 41. In order to be consistent with FIG. 4, the halo coefficient memory has $5\times5$ positions, rather than the $3\times3$ positions of the coefficient memory 42. When the display characteristics of the current pixel 25(x,y) are to be calculated, the image memory provides that data describing impulse points located in the current pixel and the neighboring pixels. The data access appropriate locations in the halo coefficient memory which activity produces the appropriate attenuation factor each impulse will apply to the background or lower priority display impulses. Each coefficient memory location includes a value used for determining the contribution of the impulse, e.g., impulse point 40, to the halo component of the current pixel 25(x,y). The results of the contributions to the halo component from all the impulse points located in the pixels in the neighborhood of the current pixel in the halo coefficient memory 71 are applied to combining unit 73 wherein the complete contribution of the haloing of all pixels in the window to the current pixel is accumulated. The contribution of the haloing to the current pixel is applied to multiplier unit 75, the output of which is entered into the second combining unit 74 along with the higher priority contribution to the anti-aliasing from the combining unit 43 and the two contributions are combined according to a predetermined algorithm, e.g., summed, the larger of the two values, etc. By way of specific example;

$$I_{out}(x,y)=I_{higher\ priority}(x,y)+H(x,y)I_B(x,y)$$

The output from the operation unit is applied to driver circuits 44. The driver circuits 44 address the current pixel and, based on the output signals from the operation unit 74, determine the display.

Figure 8:
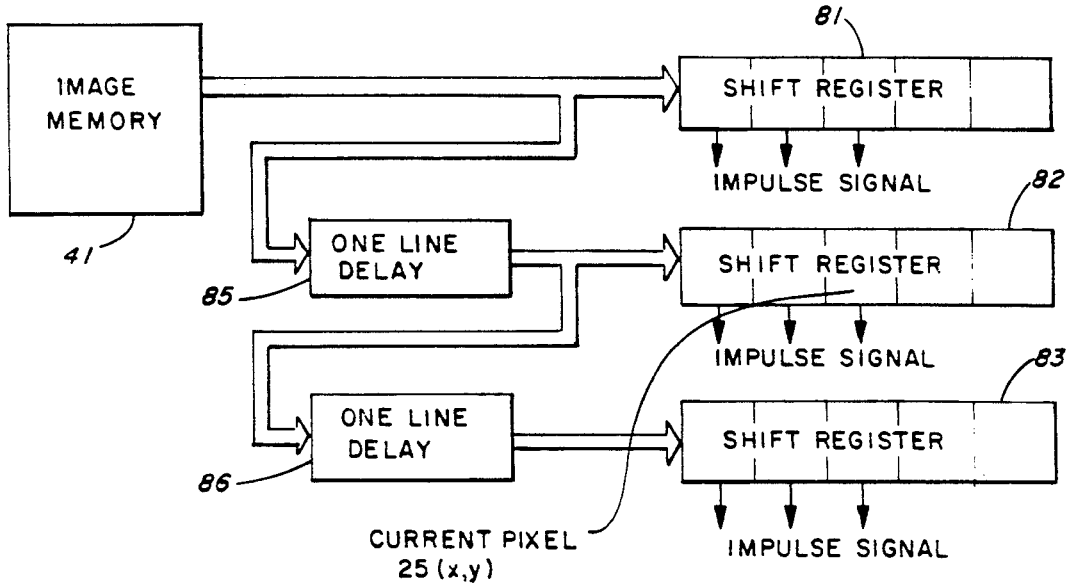
FIG. 8 illustrates a technique for organizing the impulse signals in a manner which can be applied directly to the coefficient memory in a display having a raster scan.

Referring to FIG. 8, apparatus for providing the impulse signals to access the appropriate positions of the halo coefficient memory for a raster scan display is shown. For a display, the stored impulse data is removed from the image memory, one pixel at a time and line by line, and applied to the shift register 81. The stored impulse data is also applied to delay line 85 which delays the image data by the time for one line for the storage of one line of image data. Therefore, when the first pixel stored data of display line 2 is being applied to shift register 81, the first pixel stored data of the display line 1 is being applied to the first register position of shift register 82 and to delay line 86. Similarly, when the first pixel stored data of display line 3 is being applied to shift register 81 and delay line 85, the first pixel stored data of display line 2 is being applied to shift register 82 and to delay line 86, and the first pixel stored data of display line 1 is being applied by the delay line 86 to shift register 83. When the five positions of shift register 83 have contents of an image memory location stored therewith, then the impulse signals from the shift register positions are organized in a manner appropriate for entry in the halo coefficient memory. Two more line delays and shift registers are required for the 5×5 matrix (window) of the impulse data needed to produce the halo effect. The center register position of shift register 83 corresponds to the location of the current pixel to be calculated. As the pixel stored data are removed from image memory 41 thereafter, the center register position of shift register will reference a different pixel, but the center shift register position will continue to represent the current pixel position relative to the pixels represented by positions of the shift registers 81, 82, and 83 and the two additional shift registers needed to implement the the 5×5 window.

Figure 9:
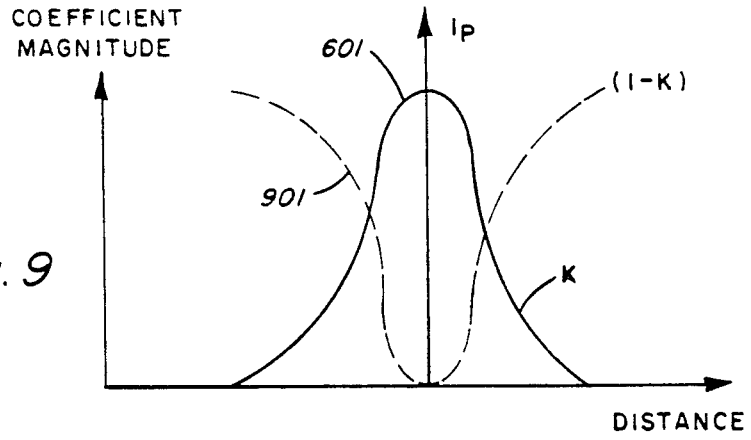
FIG. 9 illustrates the origin of the opacity function.

Referring to FIG. 9, a technique for providing an opacity display is shown. The impulse point $I_P$ has associated therewith a distribution function 601. The distribution function 601 as the shape K(distance). Associated with the impulse function distribution 601 is the opacity distribution function 901 with the shape [1−K(distance)]. The opacity function from a first set of impulse points is used to attenuate the contribution to display parameters of a pixel by a second set of impulse points of lower priority.

Figure 10:
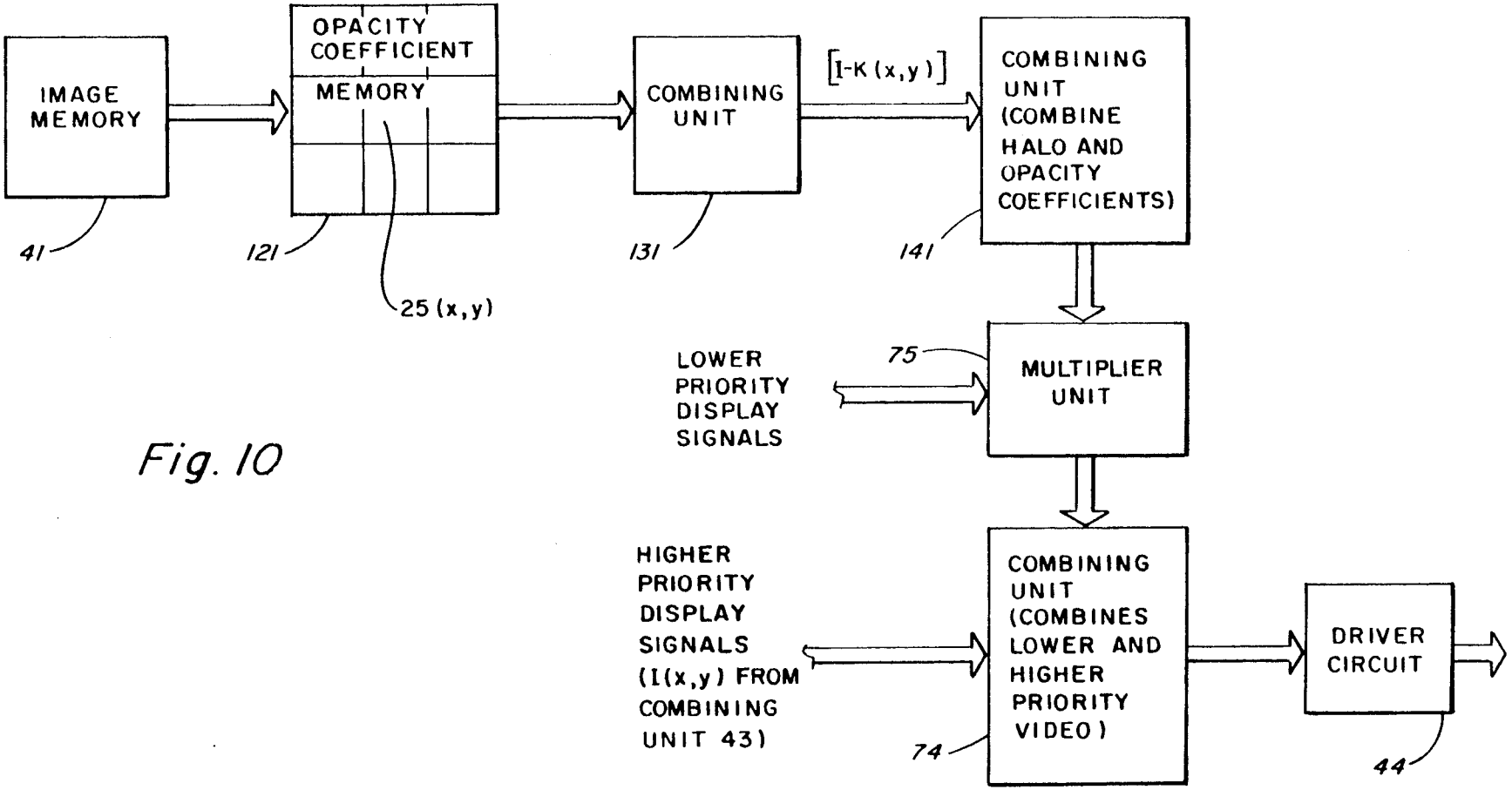
FIG. 10 is a block diagram of the apparatus for providing the opacity function in an anti-aliased display system.

Referring to FIG. 10, impulse points are extracted from the image memory 41 and applied to the opacity coefficient memory 121. The coefficient memory 121 can be implemented using the coefficients K from 42 and complementing K to form 1−K . The coefficient memory 121 determines the contributions to the current pixel, 25(x,y) from the current pixel and from the neighboring pixels of the current pixel and these contributions are combined in combining unit 131. The output signal from the combining unit 131 is the opacity coefficient taken from the combined 3×3 matrix window [1−K(x,y)] and this function is applied to the combining unit 141. In the combining unit 141, the attenuation coefficients of haloing and opacity are combined, taking the lesser of the two. The smaller the coefficient, the more attenuation is applied in the subsequent multiplier unit 75. In the multiplier unit 75, the constant [1−K(x,y)] or the value H(x,y) is multiplied by the contribution to the second set of impulse points to the display parameters of the lower priority. The current pixel and the resulting quantity are combined with the display parameters provided by contributions to the current pixel of the first set of higher priority impulse points. The resulting quantity is applied to the driver circuits 44 which activate the current pixel.

Figure 11:
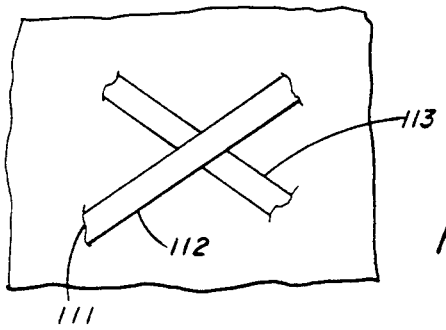
FIG. 11 is an illustration of the use of an opacity function.

Referring to FIG. 11, the application of the opacity function apparatus is illustrated. The display includes two intersecting lines 111 and 113. At the point of intersection, the the opacity function is applied to the impulse points making up line 113 so that the line 111 appears to be overlaid on line 113. The opacity function can be used with the halo 112 of line 113 so that both the line 111 and the associated halo region 112 appear to be overlaid on line 113.

2. Operation of the Preferred Embodiment

The anti-aliasing, haloing apparatus can be understood in the following manner. The halo coefficient memory 71 in conjunction with the combining unit 73 determine a constant according to the equation:

$$C(x,y)=OP_1c_{(i,j)}$$

where $OP_1$ is a combining operation, typically a summing operation, but the operation can be selection of the maximum value contributed to the current pixel;

i ranges from x−2 through x+2; and j ranges from y−2 through y+2.

Selection of the maximum value is typically used in the the situations wherein the impulse points are associated with tightly packed (i.e., neighboring) pixels and/or impulses.

The intensity of the signal to be applied to the driver circuits 44 is then:

$$I(x,y)=I_P(x,y)OP_2[I_BC(x,y)$$

where:

$I_P$(x,y) is the intensity of the impulse signals for the current pixel resulting from the imposition of the aliasing techniques;

$I_B$ is the intensity of the background field signals; and $OP_2$ is the algorithm that combines the impulse intensity and the background intensity contributions to determine the intensity signal to be applied to the driver circuits.

The $OP_2$ algorithm can be a summing operation or a selection of which contribution is greater to the current pixel.

As will be clear, the foregoing description is applicable to a monochromatic display. The extension to a chromatic display requires that each color component (and where appropriate, a grey field) be processed separately, but that the attenuation be applied without regard to color. Thus, for, example, a red line 111 can occlude a green one 113.

The opacity apparatus relies on the distribution function associated with a first set of impulse points (and the haloing associated therewith). The distribution function is used to determine the opacity function that is to be applied to a second set of lower priority points. In the region where the first set of impulse points has a contribution as determined by image memory 41 and coefficient memory 42, the second set of impulse points will be attenuated. Therefore, the contribution of the lower priority impulses to the current display pixel is attenuated in the vicinity of the first set of impulse points and unattenuated at a distance from the first set of impulse points. The display resulting from the first set of impulse points therefore appears to overlay the second set of impulse points.

The foregoing description has been directed to an example in which both the image impulse set and the halo impulse set has an anti-aliasing procedure applied thereto. In fact, in the foregoing description, the image impulse set and the halo impulse set are the same. However, the present invention can operate advantageously in the absence of both restrictions. First, the impulse set can have anti-aliasing procedures applied to the generating the halo, but not applied in generating the image. Second, the impulse set upon which the halo anti-aliasing procedure is directed does not necessarily have to be the impulse set generating the image. However, it will be clear that the halo impulse set will have a spatial relationship with the image impulse set.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. Apparatus for determining at least one display parameter for a selected pixel of a display, wherein an image to be displayed is represented by a plurality of impulse data points, each impulse data point located in a related pixel, said apparatus comprising:

an image memory for storing said impulse data point groups at locations determined by said related pixels;

first image means coupled to said image memory and responsive to first impulse data points for determining a contribution to said parameter by said first impulse data points for said selected pixel:

halo/opacity means coupled to said image memory and responsive to second impulse data points for determining a total halo/opacity contribution to said parameter for said selected pixel by said second impulse data points, wherein each parameter contribution to said total halo/opacity parameter contribution is determined by a first distribution function applied to a second impulse data, wherein second impulse data points associated with neighboring pixels of said selected pixel provide a halo/opacity contribution to said selected pixel; and combining means coupled to said first image means and to said halo/opacity means for combining said total halo/opacity parameter contribution and first impulse point parameter contribution to provide said selected pixel parameter, a combined parameter contribution used to determine at least one optical characteristic of said display.

2. The apparatus of claim 1 wherein said display is a liquid crystal display.

3. The apparatus of claim 1 wherein said second impulse points have a preestablished spatial relationship with said first impulse data points.

4. The apparatus of claim 1 wherein said second impulse data points and said first impulse data points are the same, wherein said halo/opacity means includes:

a coefficient memory for specifying coefficients for identifying a contribution to halo/opacity characteristics by impulse data points associated neighboring pixels of said selected pixel;

a multiplying means for multiplying a neighboring pixel impulse data point parameter by a neighboring pixel coefficient to obtain a neighboring pixel halo/opacity parameter contribution to said selected pixel; and combining means for combining said neighboring pixel halo/opacity parameter contribution to obtain said total halo/opacity contribution.

5. The apparatus of claim 1 wherein said first image means includes anti-aliasing apparatus, each first impulse data point associated with a pixel having a predetermined relationship with said selected pixel providing a first impulse point parameter contribution to said selected pixel determined by a second distribution function.

6. The apparatus of claim 5 wherein said first image means includes:

an image coefficient memory responsive to said first impulse data points for determining a contribution to said parameter at said selected image point by first impulse data points associated with pixel having said predetermined relationship with said selected pixel, said contribution determined by a second distribution function; and a first image combining means for combining said contributions to said parameters by said first impulse data points to provide said total image parameter contribution.

7. The apparatus of claim 1 wherein said halo/opacity means includes:

a second imaging means for determining a total second image impulse data point parameter contribution;

an opacity means coupled to said image memory and responsive to said first impulse data points for determining a total opacity coefficient for said selected pixel by said first impulse data points, wherein each contribution to said total opacity coefficient is determined by a third distribution function, said third distribution function determining an effect of each first impulse data point on said total opacity coefficient;

second combining means for combining said total halo/opacity contribution and said total opacity contribution to provide a resulting halo coefficient; and a multiplier unit, said resulting halo coefficient being applied to said multiplier unit for being multiplied by said second impulse point parameter contribution to provide a total halo/opacity contribution.

8. The apparatus of claim 7 wherein said third distribution function is given by one minus said second distribution function.

9. The apparatus of claim 5 wherein said second distribution function is one minus said first distribution function.

10. Halo/opacity apparatus for providing halo/opacity characteristics for a first set of display regions generated as a result of procedures applied to a first set impulse points retrieved from an image memory unit, wherein said impulse points in said first set of impulse points providing a total image contribution to a selected pixel, wherein said impulse points said image memory unit are stored in locations identified by a display pixel, said halo/opacity apparatus comprising:

a coefficient memory unit having a plurality of coefficient storage locations, each coefficient storage location corresponding to a pixel having predetermined relationship with said selected pixel location, wherein display parameters are being determined for said selected pixel location, each coefficient storage location for retrieving a halo/opacity coefficient contribution to said selected pixel when a second set impulse point is located in said corresponding image memory pixel location;

summing means for combining all retrieved halo/opacity contributions to said selected display pixel to provide a total halo/opacity contribution; and combining means for combining said total halo/opacity contribution and said total image contribution to determine at least one display parameter for said selected display pixel.

11. The halo apparatus of claim 10 wherein said display is a liquid crystal display.

12. The halo/opacity apparatus of claim 10 wherein said combining means can combine said total pixel halo/opacity contribution and said total image contribution in a manner determined by one of the group consisting of summing said total halo/opacity contribution and said total image contribution, and of selecting the larger of said total halo/opacity contribution and said total image contribution.

13. The halo/opacity apparatus of claim 10 wherein said halo/opacity contributions are a function of a micropositioning of an impulse point within a pixel location.

14. The halo/opacity apparatus of claim 10 wherein said halo/opacity contributions are determined by a halo/opacity distribution function.

15. The halo/opacity apparatus of claim 10 further comprising:

an opacity coefficient memory responsive to said image memory unit for providing a total opacity contribution to said selected display pixel; and a second combining means for combining said total halo/opacity contribution for said selected display pixel and said total opacity contribution to provide a new total halo/opacity contribution for said selected display pixel.

16. The halo/opacity apparatus of claim 15 wherein said first set of impulse points has a total image contribution to said selected pixel determined by a second distribution function, said first and said second set of impulse points being the same, wherein said opacity coefficient memory stores coefficients determined by 1 minus the coefficients determined by said second distribution function for said first set of impulse points.

17. The halo/opacity apparatus of claim 10 wherein said selected display pixel is determined by a raster scan, said coefficient memory unit including delay line apparatus to apply pixel impulse point data to corresponding coefficient memory locations for a selected display pixel.

18. The halo/opacity apparatus of claim 10 wherein said total image contribution for said selected pixel being determined by a second distribution function, wherein said summing means includes:

coefficient summing means responsive to said second set of impulse points for determining a total halo coefficient contribution to said selected pixel;

second image means for determining a a total second image contribution of said second set of impulse points to said selected pixel; and multiplying means for multiplying said total second image contribution and said total halo/opacity contribution to provide said new total halo/opacity contribution.

* * * * *